US008510999B2

(12) United States Patent
Gramling

(10) Patent No.: US 8,510,999 B2
(45) Date of Patent: Aug. 20, 2013

(54) GUTTER RETAINING SYSTEM

(76) Inventor: Karl Gramling, Boerne, TX (US)

( * ) Notice: Subject to any disclaimer, the term of this patent is extended or adjusted under 35 U.S.C. 154(b) by 0 days.

(21) Appl. No.: 13/005,253

(22) Filed: Jan. 12, 2011

(65) Prior Publication Data

US 2011/0099917 A1 May 5, 2011

Related U.S. Application Data

(63) Continuation-in-part of application No. 12/243,036, filed on Oct. 1, 2008, now Pat. No. 7,891,143.

(51) Int. Cl.
*E04D 13/064* (2006.01)

(52) U.S. Cl.
USPC ..... 52/12; 52/11; 52/16

(58) Field of Classification Search
USPC ..... 52/11–12, 16; 248/48.1, 48.2
See application file for complete search history.

(56) References Cited

U.S. PATENT DOCUMENTS 6,182,399 B1 * 2/2001 Pollera ..... 52/11
6,254,039 B1 * 7/2001 Zimmerman ..... 248/48.2
6,658,796 B1 * 12/2003 Higgins ..... 52/11
6,681,527 B2 * 1/2004 Baker ..... 52/12
6,701,674 B1 * 3/2004 Albracht ..... 52/12
2004/0040220 A1 * 3/2004 Baker ..... 52/12
2005/0172565 A1 * 8/2005 Riley et al. ..... 52/12

* cited by examiner

*Primary Examiner* — Brian Glessner
*Assistant Examiner* — Beth Stephan

(57) ABSTRACT

An interlocking gutter system that incorporates a gutter clip and a gutter hanger to affix a gutter to a retaining clip attached to a fascia board of a building, thereby eliminating the need to place holes in the gutter itself to insert screws or nails. The gutter hanger of the present invention is constructed of a single piece which has a hanger portion which is disposed substantially within the gutter and spans the width of the gutter to maintain the shape and structural integrity of the gutter. A vertical portion of the gutter hanger extends vertically from the hanger portion and terminates in a top portion which provides support to a leaf protection device. Alternatively, the gutter hanger is constructed of a hanger portion, and a separate vertical portion which is contiguous with the top portion, and is also slidably attachable to the hanger portion.

12 Claims, 8 Drawing Sheets

GUTTER RETAINING SYSTEM

This is a continuation-in-part patent application claiming priority to U.S. patent application Ser. No. 12/243,036, filed Oct. 1, 2008.

BACKGROUND OF THE INVENTION

1. Field of the Invention

Applicant's invention relates to a gutter retaining system for affixing a gutter to a building without placing holes in the gutter. More specifically, the present invention relates to an interlocking system that incorporates a gutter clip and a gutter hanger to affix the gutter to a retaining clip attached to a fascia board of a building, thereby eliminating the need to place holes in the gutter itself to insert screws or nails. The gutter hanger of the gutter retaining system is constructed of a single piece and incorporates an upper portion designed to support a leaf protection device. Alternatively, the upper portion is removably attached to the gutter hanger.

2. Description of the Related Art

For years property owners have struggled with the destructive effects of water on their buildings. However, by channeling the water away from the structure, building owners can reduce the damage caused by water. This can be accomplished through the use of a gutter system to channel water off the roof and away from the foundation. However, any damaged lengths of gutter or drain pipe caused by wear, improper installation, or sagging can cause leaks which can result in water damage to the building.

Traditionally, gutters have been attached by nailing the gutter directly to the building. Building contractors typically used a spike and ferrule system, in which a narrow, tubular spacer, the ferrule, is placed between the front wall of a gutter and its rear wall, ensuring that the front wall remains at a uniform distance from the rear wall. A spike or long nail is then punched through the outside of the front wall of the gutter, through the ferrule, through the back wall of the gutter, and into the wall or fascia board of the building.

A gutter installed in this way ends up with its front wall tilted forward towards the ground. Once this occurs the captured rainwater and other debris tends to pool along the outer edge of the gutter causing the weight on the outer edge of the gutter to increase, thus resulting in the gutter pulling away from the wall or fascia board. Further, while this manner of installation temporarily secures the gutter in place, it does not ensure that water will not run behind the gutter. If water is allowed to run and collect behind the gutter, eventually the integrity of the wood or fascia board begins to weaken and the gutter is slowly pulled away from the building.

The utilization of gutter hangers is the most common way in which installers have tried to improve the integrity and life of gutter systems. A gutter hanger is basically a modified spacer that is shaped like a flat plate, with both ends mined upward. A first end of the gutter hanger is inserted under the lip of the front wall of the gutter, typically located along the inner surface of the front wall of the gutter, along the top thereof. The second end, with a pre-punched nail hole, is placed against the rear wall of the gutter. A nail or screw is then inserted through the nail hole, through the rear wall of the gutter, and into the building wall or fascia board. A variation of this method includes placing the second end of the gutter hanger over the top of the rear wall of the gutter. The gutter hanger is then nailed directly into the building wall or fascia board. While these methods of installation eliminate the need for inserting the nail or screw through the front wall of the gutter, a hole is still placed through the back wall of the gutter.

Another problem associated with gutter systems is the collection of leaves, dirt and other debris in addition to water. Collection of such extraneous matter adds substantial weight to the gutter, often resulting in bending or deforming the gutter, or the gutter tearing away from the building or fascia board. As a way to prevent leaves, dirt and other debris from entering the gutter, many different leaf protection devices have emerged. Leaf protection devices are typically installed over the gutter in a manner as to substantially cover the gutter while leaving small areas of the gutter exposed so that water may collect therein. Yet, installation of such leaf protection devices—especially on preexisting gutters—is often cumbersome and time consuming.

The reason that installation of leaf protection devices is cumbersome and time consuming is that in order to install most leaf protection devices, brackets must also be installed to support those devices. Typically, the brackets need to be installed onto the gutter hangers. Yet, only certain brackets are appropriate to be installed on certain hangers. Therefore, often times not only do brackets need to be installed, but gutter hangers must be replaced as well. As a result, the nails or screws must be removed from the gutter hangers. Thus, the entire gutter system must be taken down, the gutter hangers must be changed out, the brackets must be installed, and then the gutter system must be reinstalled on the same building. Only then is it possible to install the leaf protection device.

It is therefore desirable to provide a gutter system that affixes a gutter to a building without placing holes in the gutter. It is also desirable to provide a system for affixing a gutter which reinforces the integrity of the gutter to prevent the gutter from sagging or tearing away from the building. It is also desirable to provide a gutter hanger which is constructed to incorporate support brackets to support a leaf protection device. Alternatively, it is desirable to provide a gutter hanger that is designed to allow the optional addition of support brackets at a later time with ease, and without needing to replace the gutter hanger.

BRIEF SUMMARY OF THE INVENTION

The gutter system of the present invention provides the advantage of affixing a gutter to a building or fascia board of a building without placing holes in the gutter. The gutter system of the present invention also provides the advantages of providing reinforcement of the structural integrity of the gutter while providing support brackets to support a leaf protection device. The gutter system of the present invention incorporates a gutter clip and a gutter hanger to affix the gutter to a retaining member. The retaining member has a flat vertical portion which rests flush against a fascia board of a building in the preferred embodiment. The retaining member is attached to the fascia board by a nail or screw, and is the only site of attachment of the present system to the fascia board itself. The retaining member extends vertically along the vertical portion above the screw or nail. An arm portion of the retaining member extends downwardly and outwardly from a top portion of the retaining member, and terminates in a hook portion which angles inward and upward toward the vertical portion. Thus, a hook is formed by the retaining member to hold the gutter hanger therein.

A gutter clip is designed to attach directly to the gutter. The gutter clip has a vertical portion which is disposed against the outer surface of the rear wall of the gutter, between the gutter and the fascia board. Along the lower end of the vertical portion of the gutter clip, a horizontal spacer extends outward toward the fascia board, and terminates in a vertical protrusion which extends upward and is substantially parallel to the vertical portion. This spacer portion of the gutter clip facilitates keeping the gutter substantially level where there are substantial spaces or overlay between the fascia board and the overhang of shingles, or where the fascia board is tilted inward, toward the building or structure. A hanging portion of the gutter clip is located along the top portion of the gutter clip. The hanging portion curves downward on the side of the vertical portion opposite the spacer portion, creating a cavity for receiving a top edge of the rear wall of the gutter. The hanging portion curves slightly past parallel with the vertical portion, such that it is angled slightly toward the vertical portion. Thereafter, the hanging portion terminates in an end portion which angles slightly downward and away from the vertical portion of the gutter clip.

A gutter hanger of the preferred embodiment has a hanger portion which has a first end. The first end has a vertical wall extending substantially vertically and an inward wall which projects inward, toward a vertical portion of the gutter hanger, and slightly upward. The second end is opposite the first end, and has a vertical wall extending upward from the hanger portion, and a hanging portion which curves outward toward the fascia board and then downward along the vertical portion of the retaining member, as described herein below. The intermediate section of the gutter hanger is disposed between the first and second ends and generally spans the width of the gutter, thereby maintaining the shape and structural integrity of the gutter.

A vertical portion of the gutter hanger extends vertically from the intermediate section and terminates in a top portion of the gutter hanger. The vertical portion and the top portion form the bracket support to support a leaf protection device. The top portion has a front section which generally conforms to the shape of a front portion of the leaf protection device. The rear section of the top portion extends toward the roof of the building, terminating above the intermediate section of the hanger portion. At the end of the rear section, there is a knob or boss for receiving a support strap. The knob has a small locking protrusion along its rearward portion to prevent the support strap from rotating when engaged with the knob.

The gutter clip slides over the top edge of the back wall of a gutter such that the vertical portion of the gutter clip is substantially flush with the outer surface of the back wall of the gutter, with the horizontal spacer aligning outward. The top of the back wall of the gutter slides into the hanging portion, such that part of the hanging portion and the end portion are on the inner surface of the back wall of the gutter.

The gutter hanger is then inserted into the gutter. The inward wall of the first end of the gutter hanger engages the lip on the inner surface of the front wall of the gutter, and the vertical wall of the first end of the gutter hanger abuts against a portion of the front wall of the gutter. The second end of the gutter hanger is placed over the gutter clip such that the vertical wall of the second end of the gutter hanger contacts the hanging portion and the end portion of the gutter clip on the inside of the rear or back wall of the gutter. The hanging portion of the gutter hanger then wraps around the hanging portion of the gutter clip. The intermediate section of the gutter hanger is disposed within the gutter and lies across the width of the gutter.

The gutter, gutter clip, and gutter hanger are installed on the building by placing the gutter hanger between the vertical portion and the hook portion of the retaining member. After securing the gutter, a leaf protection device may be installed over the top portion of the gutter hanger. Screws or nails can be placed through the leaf protection device and into the top portion of the gutter hanger to secure the leaf protection device to the hanger.

Optionally, prior to installing the leaf protection device, a support strap may be removably attached to the top portion. The support strap has a clip for receiving the knob on the rear section of the top portion of the gutter clip. The clip slides onto the knob, and the strap extends toward the roof, where it can rest on the roof. As installed, the support strap relieves part of the stress placed on the top portion and the vertical portion of the gutter clip by the leaf protection device. The locking protrusion prevents rotation of the strap with respect to the knob, so that the strap can rest on the roof in a fixed position and support the vertical portion without penetrating the roof with nails or screws to attach the support strap to the roof.

DETAILED DESCRIPTION OF THE INVENTION

Figure 1:
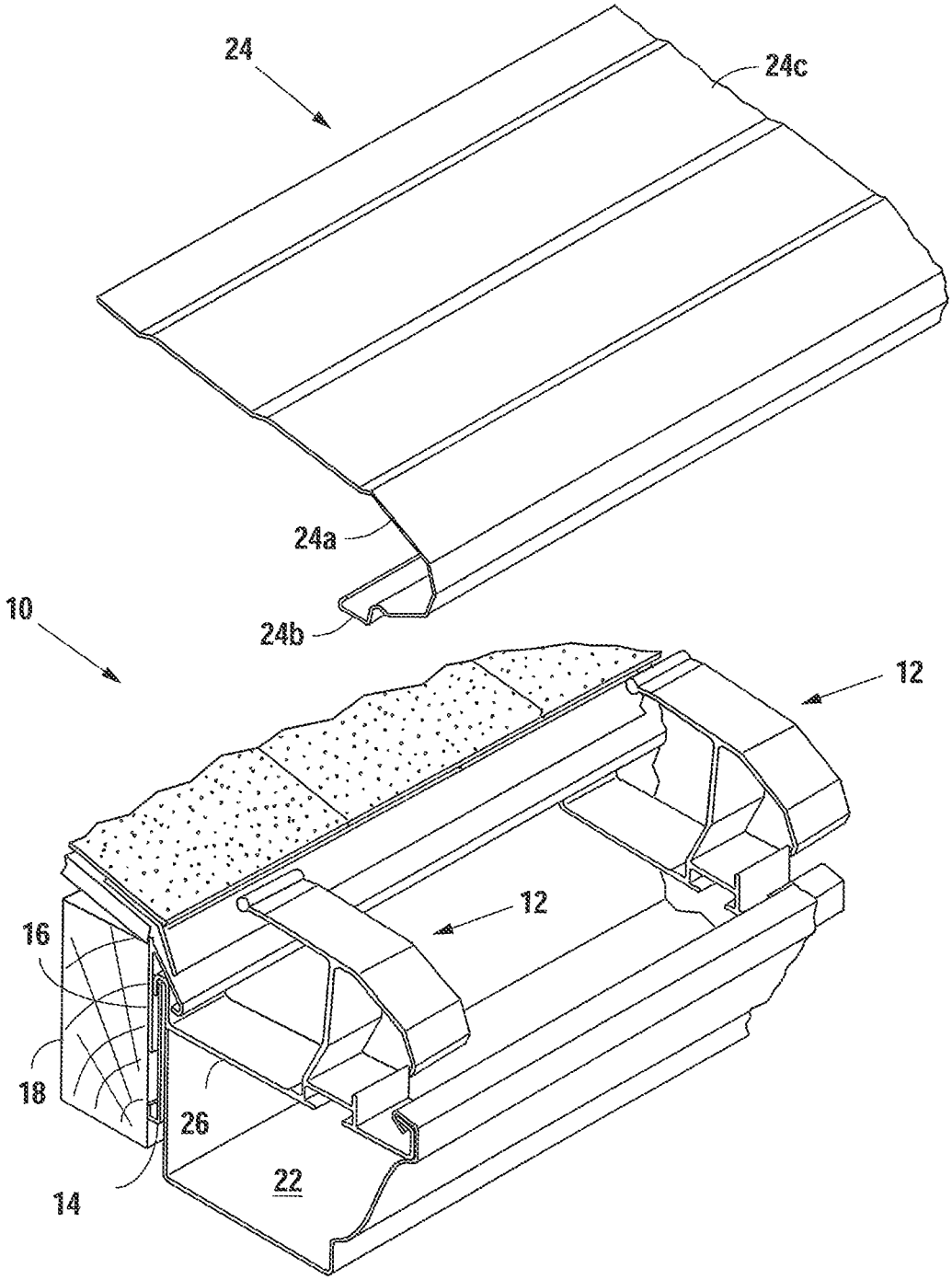
FIG. 1 is a perspective view of the gutter system of the present invention with a leaf protection device.
Figure 2:
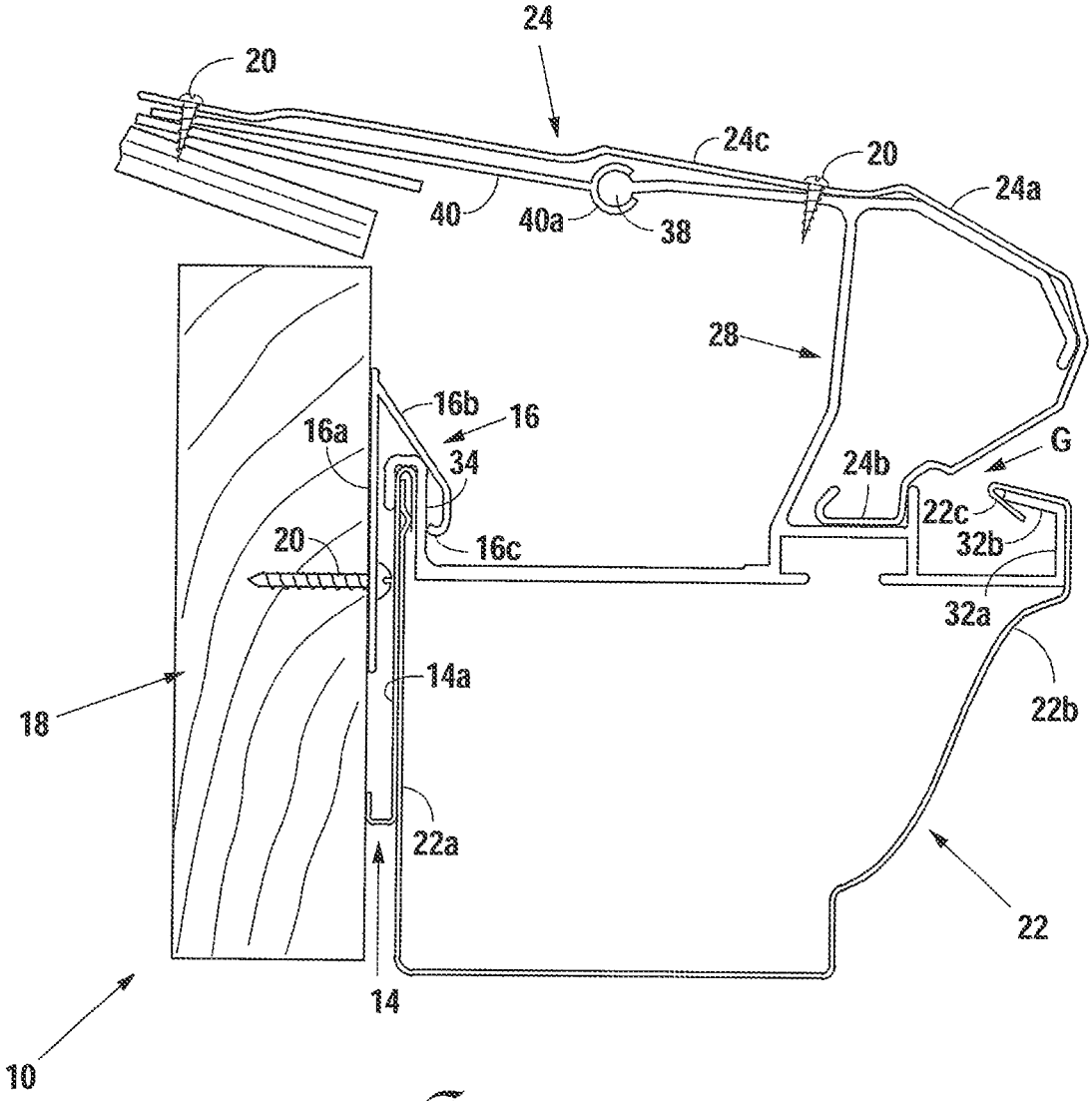
FIG. 2 is a side view of the gutter system of the present invention showing the leaf protection device resting on the gutter hanger.
Figure 3:
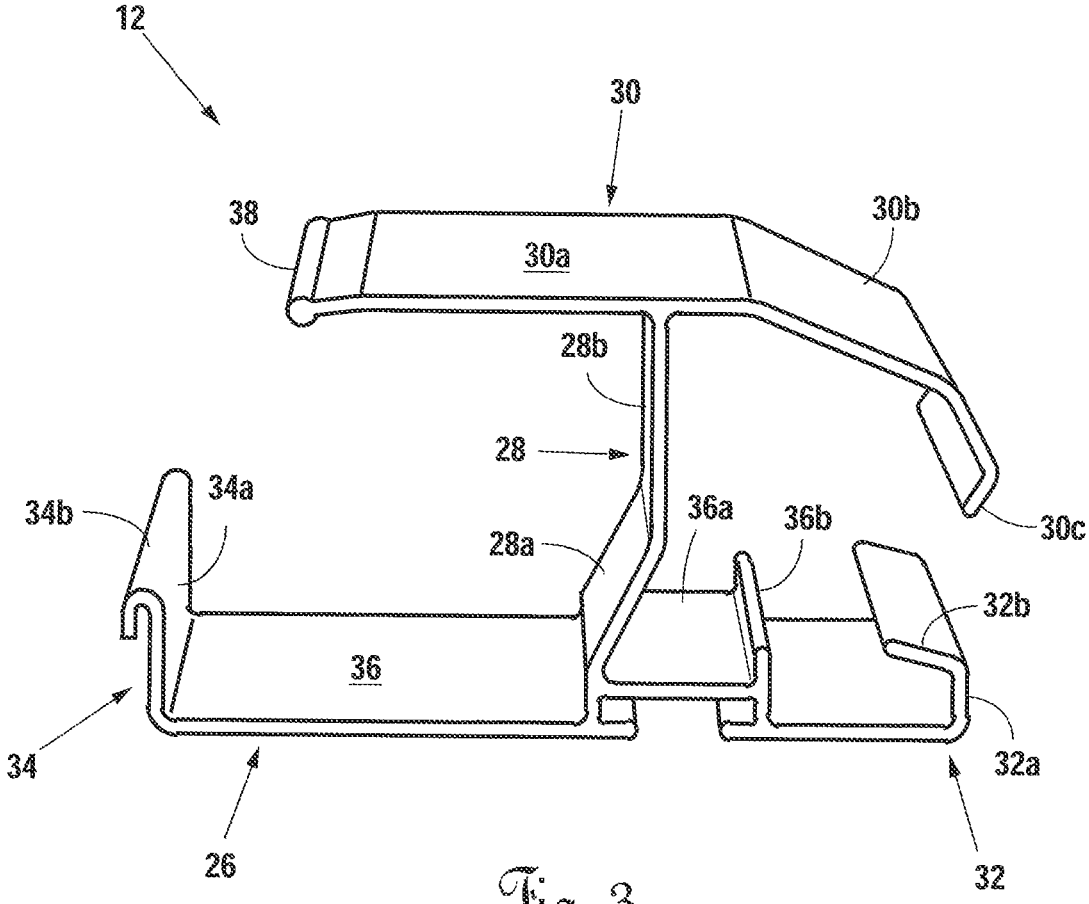
FIG. 3 is a perspective view of the gutter hanger of the present invention.
Figure 8:
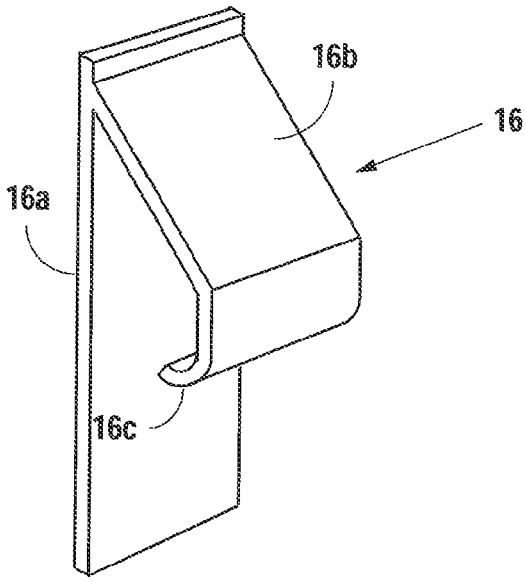
FIG. 8 is a perspective view of the retaining member of the present invention.

Referring to FIGS. 1, 2 and 3, the gutter system 10 of the present invention is disclosed. The gutter system 10 comprises a gutter hanger 12, a gutter clip 14 and a retaining member 16. As shown in FIGS. 2 and 8, the retaining member has a vertical portion 16*a* which lies flush against a fascia board 18, and is secured thereto by a screw 20. In the present gutter system 10, the screw 20 being place through the retaining member 16 and into the fascia board 18 is the only point of attachment between the gutter 22 and the building or structure (not shown). However, a nail or other appropriate attaching device could be used in place of the screw 20. The retaining member 16 has an arm 16*b* on the upper end of vertical portion 16*a* which extends downward and outward from the upper end of the vertical portion 16*a*. A hook portion 16*c* is contiguous with arm 16*b*, and angles inward and upward toward vertical portion 16*a*. As discussed in detail below, the gutter clip 14 and gutter hanger 12 are secured to the retaining member 16 between the hook portion 16*c* and the vertical portion 16*a*.

Furthermore, although the retaining member 16 is shown and described as having a vertical member that is flush against the fascia board 18, various modifications of the retaining member 16 could be made. For instance, the modifications disclosed in U.S. patent application Ser. No. 10/939,246, wherein a horizontal spacer extends from a lower part of vertical portion 16*a* opposite arm 16*b* and hook portion 16*c* to accommodate different slanting angles of the fascia board 18.

Figure 9:
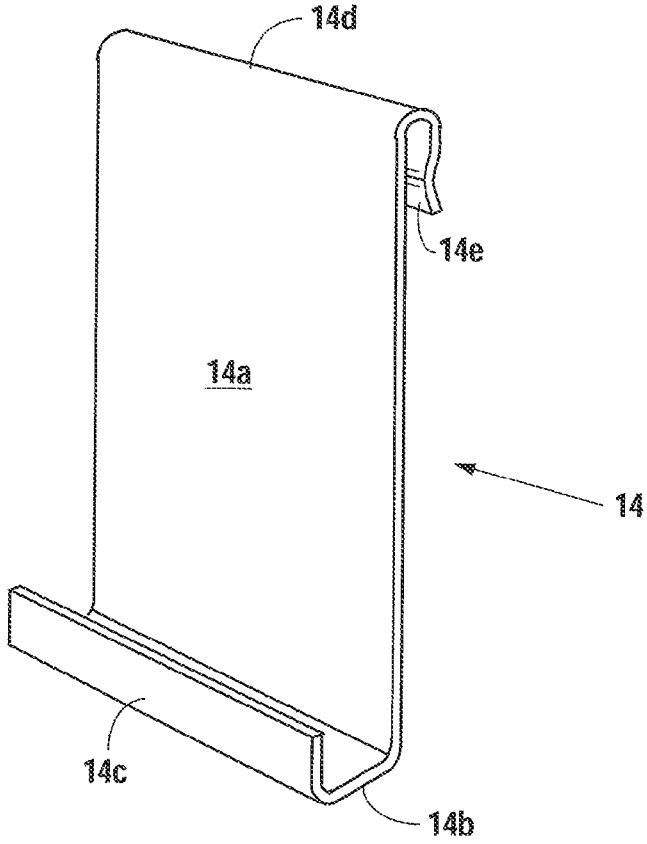
FIG. 9 is a perspective view of the gutter clip of the present invention.

Referring to FIGS. 2 and 9, the gutter clip 14 of the gutter system 10 is shown. The gutter clip 14 has a vertical portion 14*a*. At a lower end of vertical portion 14*a*, a horizontal spacer 14*b* extends outward, and a vertical protrusion 14*c* extends upward, substantially parallel to vertical portion 14*a* from the end of the spacer 14*b*. The spacer 14*b* aides in keeping the gutter substantially level when the gutter hanger 12 is attached to the retaining member 16. Thus, spacer 14*b* separates the rear wall 22*a* of the gutter 22 from the fascia board 18. A hanging portion 14*d* of the gutter clip 14 is located along the top of the gutter clip 14. The hanging portion 14*d* curves downward on the side of vertical portion 14*a* opposite spacer 14*b*, creating a cavity for receiving a top portion of the rear wall 22*a* of gutter 22. Hanging portion 14*d* curves past parallel with vertical portion 14*a* to angle slightly toward vertical portion 14*a*. Thereafter, hanging portion 14*d* terminates in an end portion 14*e* which angles downward and outward from said vertical portion 14*a*.

Hanging portion 14*d* of gutter clip 14 slides over the top edge of rear wall 22*a* of gutter 22. As engaged with rear wall 22*a*, vertical portion 14*a* of gutter clip 14 is substantially flush with the outer surface of rear wall 22*a*, and spacer 14*b* is aligned outward from rear wall 22*a*. The top of rear wall 22*a* slides into the cavity between vertical portion 14*a* and hanging portion 14*d* such that part of hanging portion 14*d* and end portion 14*e* are disposed along the inner surface of rear wall 22*a*. Hanging portion 14*d* and end portion 14*e* are then crimped toward vertical portion 14*a* using a pair of pliers or other suitable crimping device, thus securing gutter 22 to gutter clip 14.

Referring to FIGS. 1, 2 and 3, the preferred embodiment of gutter hanger 12 is disclosed. In the preferred embodiment, gutter hanger 12 is constructed of a single piece, having a hanger portion 26, a vertical portion 28 and a top portion 30. Hanger portion 26 reinforces and helps maintain the structural shape and integrity of gutter 22, whereas vertical portion 28 and top portion 30 serve as a support bracket for a leaf protection device 24. Hanger portion 26 has a first end 32 which engages a portion of front wall 22*b* of gutter 22. First end 32 has a vertical wall 32*a* and an inward wall 32*b*. Inward wall 32*b* is angled inward, toward vertical portion 28, and slightly upward. As shown in FIGS. 1 and 2, inward wall 32*b* engages a lip 22*c* of front wall 22*b*, and is disposed between said lip 22*c* and the inner surface of front wall 22*b*. Likewise, vertical wall 32*a* is disposed along the inner surface of front wall 22*b*, along a portion thereof.

Referring to FIG. 3, hanger portion 26 of gutter hanger 12 has a second end 34 disposed on the opposite end of hanger portion 26 from first end 32. Second end 34 has a vertical wall 34*a* extending upward and a hanging portion 34*b*. Hanging portion 34*b* extends downward from vertical wall 34*a*, and extends parallel to vertical wall 34*a* for a slight distance, forming a cavity for receiving the hanging portion 14*d* and end portion 14*e* of gutter clip 14, which is attached to rear wall 22*a* of gutter 22. An intermediate section 36 of hanger portion 26 is disposed between first end 32 and second end 34, forming a contiguous hanger portion 26. Intermediate section 36 is disposed across and inside gutter 22. Referring to FIGS. 1 and 2, once second end 34 receives hanging portion 14*d* and end portion 14*e* of gutter clip 14, second end 34 of gutter hanger 12 may be crimped using pliers or other suitable crimping devices to secure gutter hanger 12 to gutter clip 14, and thus, gutter 22. Once secured, second end 34 is inserted into a cavity between hook portion 16*c* and vertical portion 16*a* of retaining member 16. Second end 34 fits tightly within the cavity between hook portion 16*c* and vertical portion 16*a* to allow retaining member 16 to securely hold gutter 22, gutter hanger 12 and gutter clip 14.

Returning to FIG. 3, vertical portion 28 extends generally upward from intermediate section 36, and terminates at top portion 30. As shown, vertical portion 28 has a lower section 28*a* that extends generally upward and outward toward a front section 30*b* of top portion 30. An upper section 28*b* of vertical portion 28 is adjacent lower section 28*a* and extends vertically from lower section 28*a*. Upper section 28*b* is substantially perpendicular to a rear section 30*a* of top portion 30 and intermediate section 36. A platform 36*a* is contiguous with and elevated above intermediate section 36. On one end of the platform 36*a*, a small vertical wall 36*b* extends vertically slightly above platform 36*a*. On the opposite end, platform 36*a* adjoins lower section 28*a* of vertical portion 28. Platform 36*a* is disposed between first end 32 of hanger portion 26 and vertical portion 28.

Front section 30*b* of top portion 30 extends outward from rear section 30*a*, and angles downward toward first end 32. An end section 30*c* terminates front section 30*b* and angles downward and slightly inward from first end 32. As shown in FIG. 2, end section 30*c* is disposed above first end 32, rearward of vertical wall 32*a*. Rear section 30*a* is substantially horizontal and extends rearward from vertical portion 28. Rear section 30*a* terminates in a knob 38. Top portion 30 as shown accommodates and supports a "nose forward" leaf protection device, as is commonly known in the art. However, top portion 30 could be designed to accommodate other types of leaf protection devices.

Figure 10:
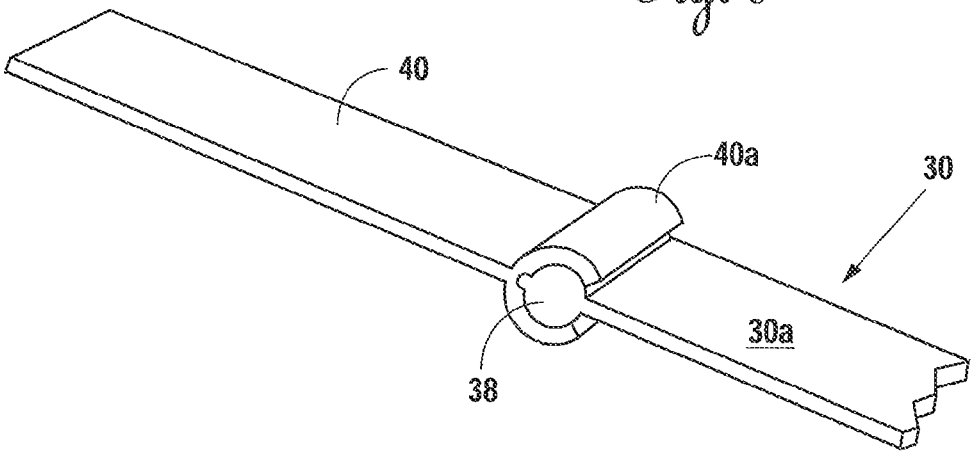
FIG. 10 is a perspective view of the support strap of the present invention.

Referring to FIGS. 1, 2 and 3, once second end 34 is secured within retaining member 16 between hook portion 16*c* and vertical portion 16*a*, the leaf protection device 24 may be installed. Prior to installing leaf protection device 24, a support strap 40 is removably attached to top portion 30. Referring to FIG. 10, support strap 40 has a clip 40*a* on one end thereof which receives knob 38 of rear section 30*a*. Clip 40*a* slides onto knob 38. The locking protrusion at the rear portion of knob 38 is engaged to a second recess within clip 40*a* to prevent vertical rotation of the support strap 40 with regard to knob 38. However, the support strap 40 can slide laterally with respect to knob 38. Support strap 40 extends rearward and contacts a roof (not shown) of the building. Support strap 40 aids in relieving stress placed on top portion 30 and vertical portion 28 by leaf protection device 24. It should be understood that support strap 40 could be eliminated from the system 10, in which case leaf protection device 24 could be placed directly on top portion 30 without having support strap 40 anchoring top portion 30 to the roof.

Referring to FIG. 2, leaf protection device 24 is placed over top portion 30. Nose portion 24*a* of leaf protection device 24 substantially conforms to the shape of front section 30*b* of top portion 30. Nose portion 24*a* extends over end portion 30*c* of front portion 30*b* and extends downward and inward toward platform 36*a* of intermediate section 36. There is a gap G between lip 22*c* of gutter 22 and leaf protection device 24, thus allowing the entry of water into gutter 22 while substantially preventing leaves and other debris from entering gutter 22. A base 24*b* of leaf protection device 24 rests on platform 36*a* and is prevented from sliding laterally off of platform 36*a* by vertical portion 28 and vertical wall 36*b*. By providing platform 36*a* to receive base 24*b*, the weight of nose portion 24*a* on front section 30*b* is reduced, thus reducing the stress load on front section 30*b*. Body portion 24*c* of leaf protection device 24 extends toward the roof of the building, covering rear section 30*a*, knob 38, and support strap 40. A screw 20 is placed through body 24*c* and into the roof of the building to secure leaf protection device 24 to the building. Likewise, a screw 20 may optionally be placed through body portion 24*c* and rear section 30*a* of top portion 30 to further secure leaf protection device to gutter hanger 12.

Figure 4:
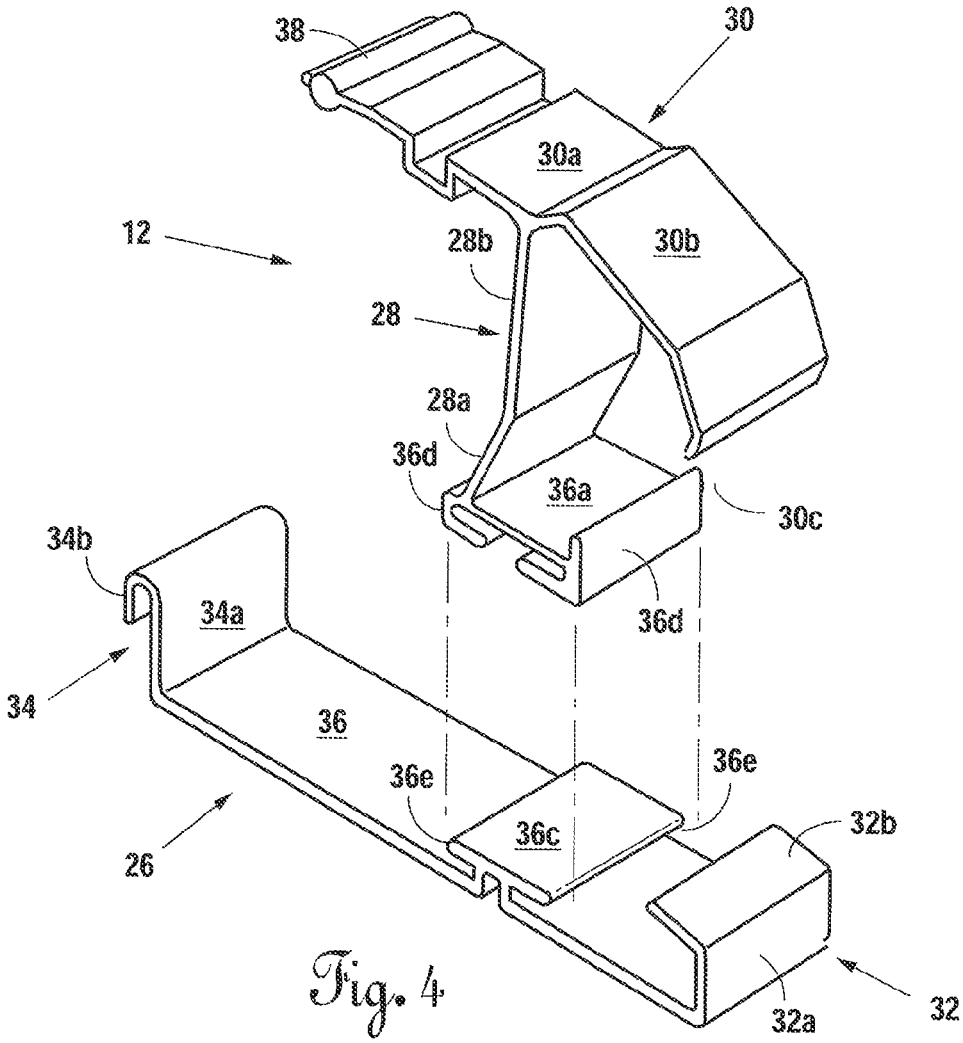
FIG. 4 is a perspective view of an alternative embodiment of the gutter hanger of the present invention.
Figure 5:
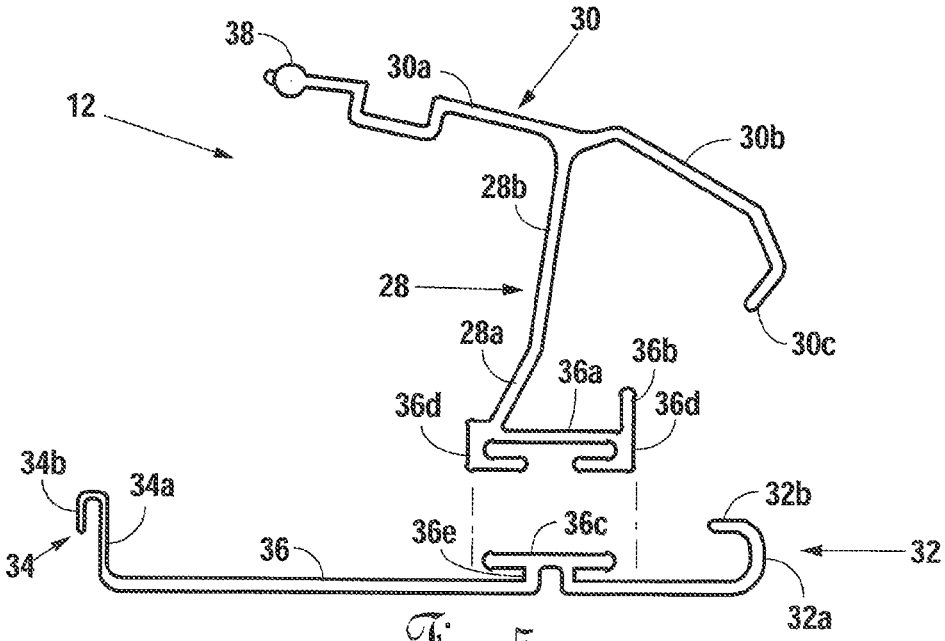
FIG. 5 is a side view of an alternative embodiment of the gutter hanger of the present invention.

Referring now to FIGS. 4 through 7, an alternative embodiment of the present invention is disclosed. Referring to FIGS. 4 and 5, in the alternative embodiment, gutter hanger 12 is constructed such that vertical portion 28 is separate, but slidably attachable to hanger portion 26. Vertical portion 28 has lower section 28*a* and upper section 28*b* which terminates at top portion 30. Thus, vertical portion 28 and top portion 30 are constructed of a single piece. Lower section 28*a* terminates at platform 36*a*. However, platform 36*a* is not contiguous with intermediate section 36 of hanger portion 26. Instead, there is a receiving surface 36*c* on which platform 36*a* rests when vertical portion 28 is slidably attached to hanger portion 26. Receiving surface 36*c* is elevated above, but contiguous with intermediate section 36. Legs 36*e* are disposed underneath receiving surface 36*c* and are contiguous with intermediate section 36 and receiving surface 36*c*. By being disposed underneath receiving surface 36*c*, legs 36*e* define grooves for slidably receiving platform 36*a*. Legs 36*d* extend vertically downward from platform 36*a*. Legs 36*d* extend downward from platform 36*a* and turn inward toward one another below platform 36*a*, forming a receiving cavity substantially the same size and shape as intermediate section 36 formed by legs 36*e* and receiving surface 36*c* of hanger portion 26. This construction allows vertical portion 28 to be slidably attached to hanger portion 26, as shown in FIGS. 4 and 5.

Figure 6:
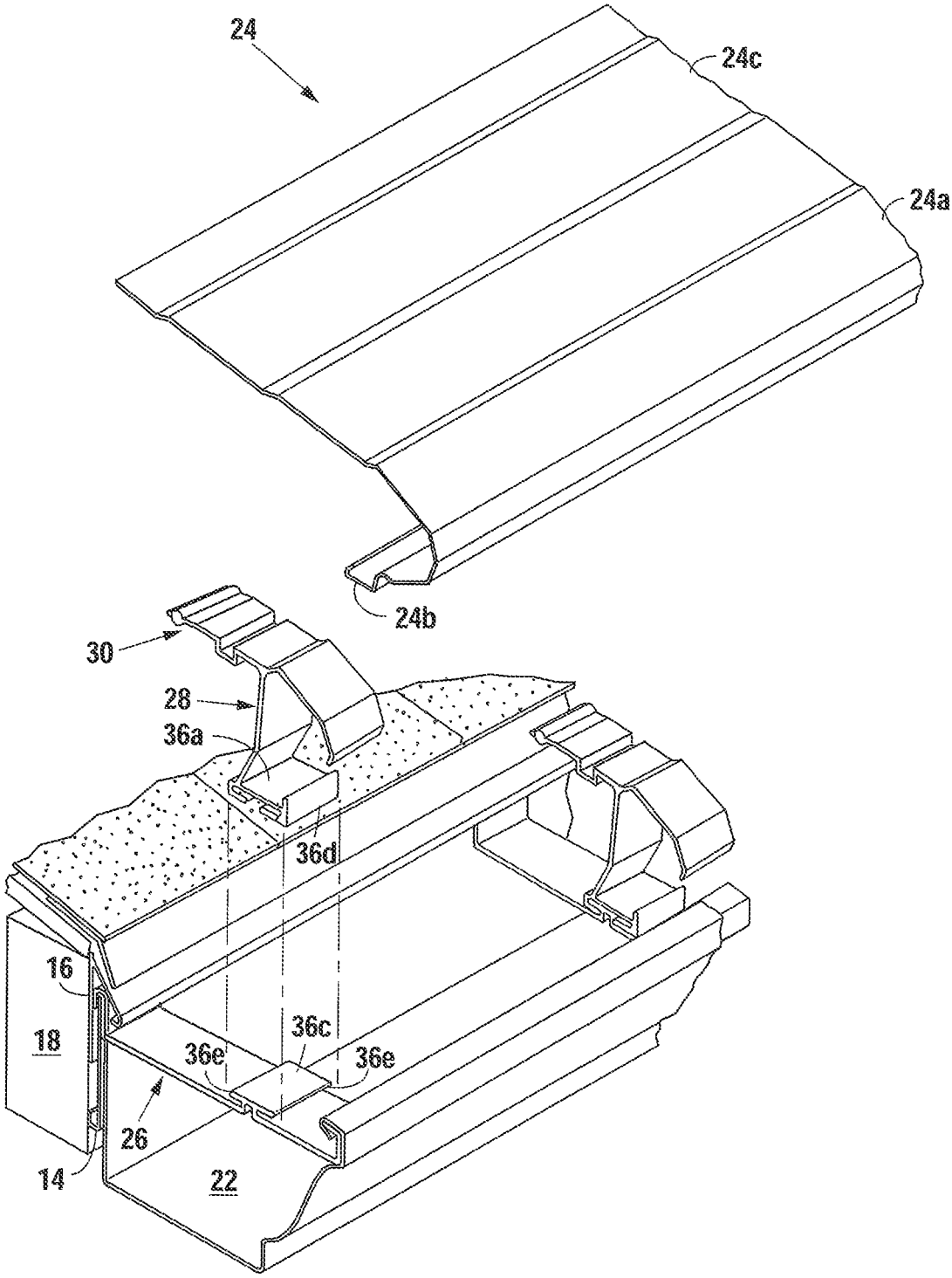
FIG. 6 is a perspective view of the gutter system of the present invention with the alternative embodiment of the gutter hanger.
Figure 7:
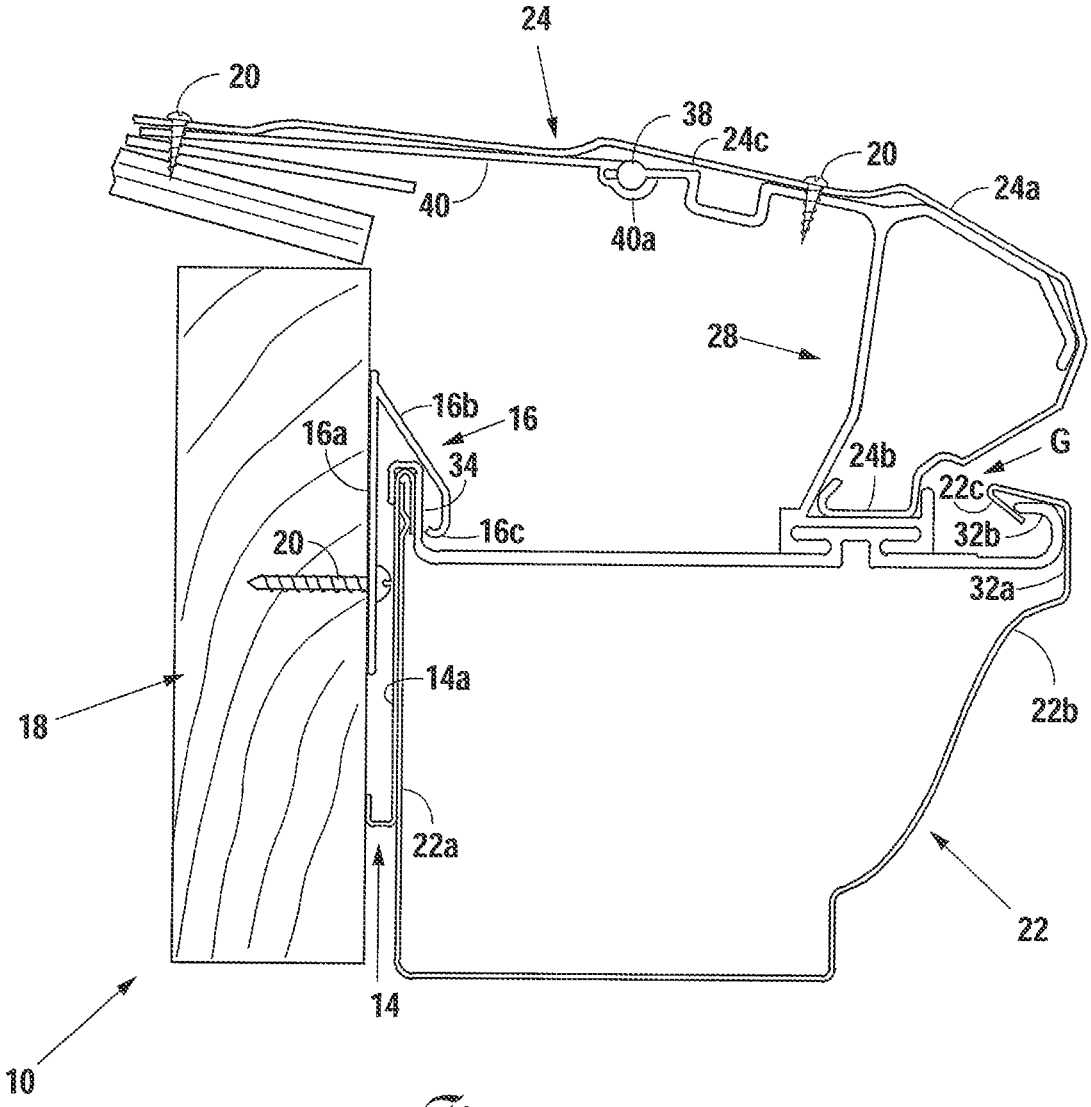
FIG. 7 is a side view of the gutter system of the present invention showing the leaf protection device resting on the alternative embodiment of the gutter hanger.

The advantage of having an a two-piece gutter hanger 12 as described hereinabove, is shown in FIGS. 6 and 7. The hanger portion 26 can readily be installed in the gutter system 10, as described herein. However, if it is not desired to install a leaf protection device 24, there is no need to install vertical portion 28 and top portion 30. An advantage of this embodiment is that if it is later desired to add a leaf protection device 24 to the gutter system 10 wherein hanger portion 26 is already installed, vertical portion 28 can slide onto hanger portion 26, allowing leaf protection device 24 to be installed on top of the gutter system 10 as described herein, without the need to remove the gutter 22, gutter clip 14 and hanging portion 26 from the retaining member 16 to replace hanging portion 26 with a one piece gutter hanger 12. Moreover, the attachment of the vertical portion 28 to the hanger portion 26 by the groove formed underneath platform 36*a* corresponding to the shaped formed by legs 36*e* and receiving surface 36*c* allows the vertical portion 28 to slide laterally with respect to hanger portion 26. The ability to slide laterally provides an advantage in that it prevents buckling of the gutter 22 and/or leaf protection device 24 as movement of the component parts of the system 10 occurs, especially during summer months as the temperature rises. Moreover, although described as being a part of the system 10 of the present invention, it should be understood that hanger portion 26 and vertical portion 28 can be installed on pre-existing gutters that are not part of the system 10.

Figure 11:
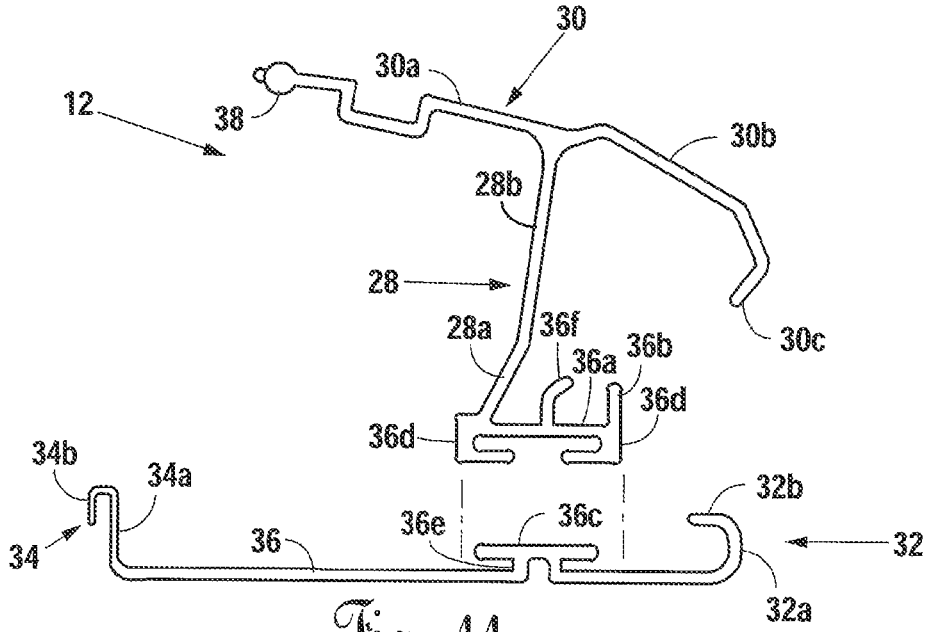
FIG. 11 is a side view of an alternative embodiment of the gutter hanger of the present invention.
Figure 12:
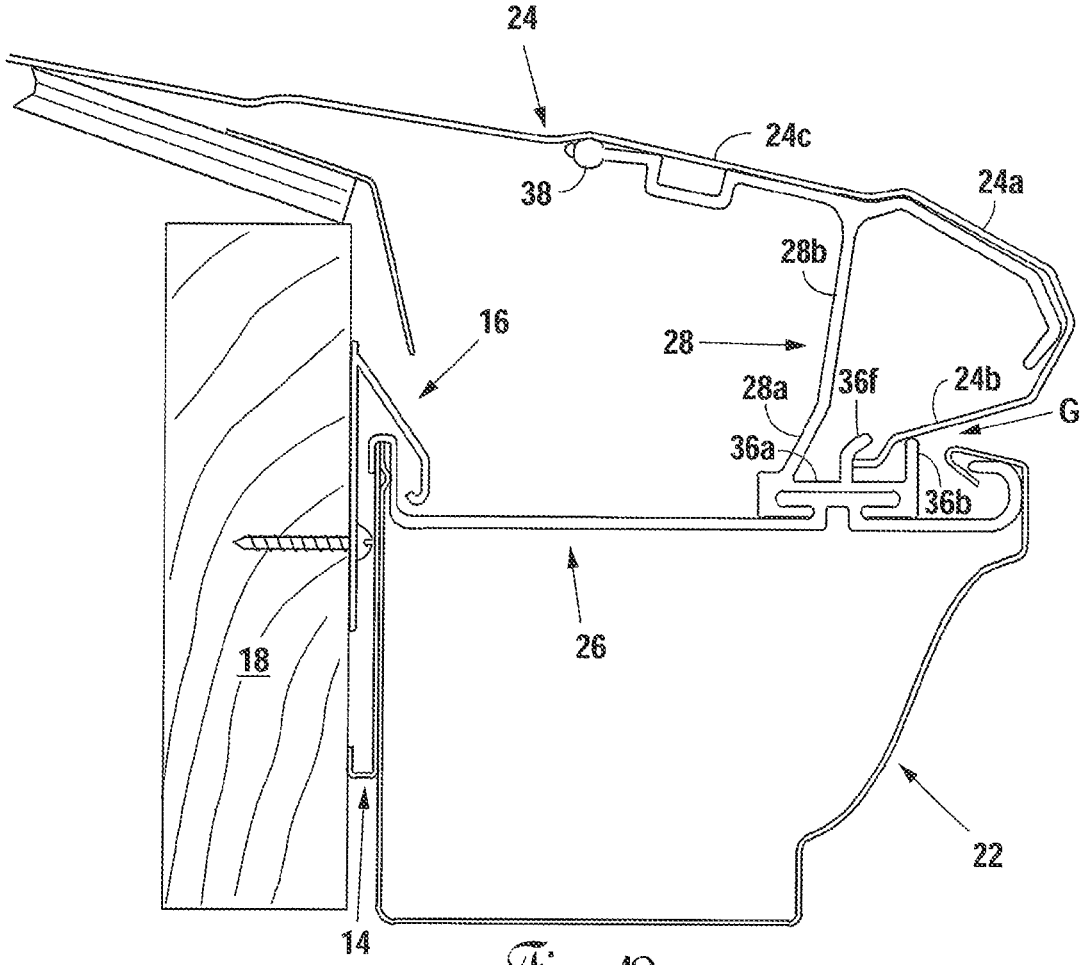
FIG. 12 is a side view of the gutter system of the present invention with an alternative embodiment of the gutter hanger.

Referring to FIGS. 11 and 12, another embodiment of the present invention is disclosed. Gutter hanger 12 is constructed such that vertical portion 28 is separate, but slidably attachable to hanger portion 26 in the same manner as disclosed hereinabove in reference to the embodiment of gutter hanger 12 shown in FIGS. 4 through 7. However, in the embodiment shown in FIGS. 11 and 12, a backstop 36*f* extends vertically from platform 36*a*, and curves slightly forward toward vertical wall 36*b*. As shown in FIG. 12, base 24*b* of leaf protection device 24 is inserted between backstop 36*f* and vertical wall 36*b* and rests there between. The slight forward curvature of backstop 36*f* prevents base 24*b* from sliding out of the space between backstop 36*f* and vertical wall 36*b*. This embodiment accommodates shorter bases 24*b*, as exist on some leaf protection devices. It should be understood that backstop 36*f* can be eliminated altogether, or placed anywhere along platform 36 to accommodate the varying bases of different leaf protection devices.

Backstop 36*f* is shown as being disposed approximately half way between lower section 28*a* of vertical portion 28 and vertical wall 36*b*. However, backstop 36*f* could be placed at any position along platform 36*a* between lower section 28*a* and vertical wall 36*b* so long as the distance between backstop 36*f* and vertical wall 36*b* is sufficient to receive base 24*b* of leaf protection device 24. Furthermore, although gutter hanger 12 is shown the embodiment disclosed in FIGS. 11 and 12 as having vertical portion 28 separate but attachable to hanger portion 26, gutter hanger 12 having backstop 36*f* could be comprised of a single piece, as disclosed in FIGS. 1 through 3.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is, therefore, contemplated that the appended claims will cover such modifications that fall within the scope of the invention.

I claim:

1. A hanger for supporting a leaf protection device and reinforcing a gutter without placing a hole in said gutter, said hanger comprising:

a hanger portion comprising a first end formed to engage a lip disposed along a front wall of said gutter, an intermediate section adjacent said first end, and a second end formed to receive a top edge of a rear wall of said gutter and disposed adjacent said intermediate section;

a vertical portion substantially perpendicular to said hanger portion, said vertical portion being slidably and removably attached to said intermediate section;

a top portion adjacent said vertical portion comprising a rear section substantially parallel to said intermediate section of said hanger portion and a front section adjacent said rear section;

said front section being angled generally downward and outward toward said first end of said hanger portion and terminating substantially above and rearward said first end;

wherein said intermediate section of said hanger portion comprises a receiving surface being elevated above said intermediate section by at least one leg disposed underneath said receiving surface and contiguous with said receiving surface and said intermediate section; and wherein said vertical portion comprises a platform adjacent the lower end of said vertical portion, said platform comprising two legs on opposite ends of said platform from each other and extending downward there from and turning inward toward one another to define a cavity for receiving said receiving surface.

2. The hanger as disclosed in claim 1 further comprising:

a knob terminating an end of said rear section of said top portion opposite said front section wherein said knob has a locking protrusion on a rearward portion thereof; and a support strap slidably and removably attached to said knob, said support strap terminating in a clip for receiving said knob and said locking protrusion to removably attach said support strap to said top portion of said hanger.

3. The hanger as disclosed in claim 1 wherein said first end of said hanger portion comprises a vertical wall and an inward wall adjacent said vertical wall, said inward wall extending substantially inward toward said vertical portion of said hanger.

4. The hanger as disclosed in claim 1 wherein said second end of said hanger portion comprises a vertical wall adjacent said intermediate section and a downwardly curved hanging portion adjacent said vertical wall.

5. The hanger as disclosed in claim 1 wherein said front section of said top portion comprises a first panel which angles downward and outward from said rear section, a second panel which angles downward and outward from said first panel, and an end panel which angles downward and inward from said second panel.

6. The hanger as disclosed in claim 1 wherein said vertical portion of said hanger comprises:

a lower section adjacent said platform and extending upward therefrom, said lower section angling toward said front section of said top portion; and an upper section adjacent said lower section and extending upward, said upper section being substantially perpendicular to and adjacent said rear section of said top portion and substantially perpendicular to said intermediate section of said hanger.

7. A system for mounting a gutter and leaf protection device to a building without placing holes in said gutter, said system comprising:

a gutter comprising a front wall having a lip, a bottom wall adjacent said front wall, and a rear wall adjacent said bottom wall;

a retaining member comprising a vertical portion, an arm portion adjacent a top section of said vertical portion and angling outward and downward from said vertical portion and a hook portion adjacent said arm portion and angling inward and upward toward said vertical portion;

a gutter clip comprising a vertical portion, a horizontal spacer on a lower end of said vertical portion and extending outward there from, a hanging portion adjacent a top end of said vertical portion, said hanging portion being downwardly curved to receive a top edge of said rear wall of said gutter and terminating in an end portion which is slightly angled downward and outward from said hanging portion; and a hanger for reinforcing said gutter and supporting a leaf protection device comprising a hanger portion having a first end formed to engage said lip of said front wall of said gutter, a second end formed to receive said hanging portion of said gutter clip, and an intermediate section adjacent said first end and said second end, a vertical portion substantially perpendicular to and slidably and removably attached to said intermediate section, said vertical portion having a top portion adjacent said vertical portion, said top portion comprising a rear section and a front section adjacent said rear section;

wherein said hanging portion of said gutter clip receives said top edge of said rear wall of said gutter such that said end portion and part of said hanging portion of said gutter clip are disposed along an inner surface of said rear wall of said gutter; and wherein said second end of said hanger receives said hanging portion of said gutter clip and said retaining clip receives said second end of said hanger between said hook portion and said vertical portion of said retaining clip.

8. The system for mounting a gutter and leaf protection device to a building as disclosed in claim 7 wherein:

said first end of said hanger further comprises a vertical wall adjacent said intermediate section of said hanger and an inward wall adjacent said vertical wall, said inward wall extending substantially inward toward said vertical portion of said hanger; and said second end of said hanger further comprises a vertical wall adjacent said intermediate section of said hanger and a downwardly curved hanging portion adjacent said vertical wall of said second end.

9. The system for mounting a gutter and leaf protection device to a building as disclosed in claim 8 wherein said front section of said top portion of said hanger further comprises a first panel which angles downward and outward from said rear section, a second panel which angles downward and outward from said first panel, and an end panel which angles downward and inward from said second panel, such that said front section substantially conforms to the shape of a front portion of a leaf protection device.

10. The system for mounting a gutter and leaf protection device to a building as disclosed in claim 9 further comprising:

a knob terminating an end of said rear section of said top portion opposite said front section wherein said knob has a locking protrusion on a rearward portion thereof; and a support strap removably and slidably attached to said knob, said support strap terminating in a clip for receiving said knob and said locking protrusion to removably and slidably attach said support strap to said top portion of said hanger.

11. The system for mounting a gutter and leaf protection device to a building as disclosed in claim 10 wherein:

said hanger portion has a receiving surface elevated above and adjacent said intermediate section of said hanger, said receiving surface having a first vertical leg and second vertical leg opposite said first vertical leg, said first vertical leg and second vertical leg being disposed underneath said receiving surface and contiguous with said intermediate section and said receiving surface;

said vertical portion comprising a platform having a first vertical leg and a second vertical leg opposite said first vertical leg extending downward from said platform and turning inward toward one another, defining a cavity for slidably receiving said receiving surface to slidably attach said vertical portion and top portion of said hanger to said hanger portion of said hanger.

12. The system for mounting a gutter and leaf protection device to a building as disclosed in claim 11 wherein said platform of said hanger further comprising a vertical protrusion disposed on an end of said platform opposite said vertical portion of said hanger, and a backstop disposed between said vertical portion of said hanger and said vertical protrusion, said backstop extending substantially upward from said platform.

* * * * *